US006063457A

United States Patent [19]

Anderson

[11] Patent Number: 6,063,457

[45] Date of Patent: May 16, 2000

[54] FUNCTIONAL TABLECLOTH ASSEMBLY HAVING ITEM PLACEMENT INDICATORS AND HOLDER ELEMENTS

[76] Inventor: Judy K. Anderson, 3380 Monaco Pkwy., Denver, Colo. 80207

[21] Appl. No.: 09/089,041

[22] Filed: Jun. 2, 1998

Related U.S. Application Data

[60] Provisional application No. 60/048,509, Jun. 4, 1997.

[51] Int. Cl.[7] ..... A47G 33/04

[52] U.S. Cl. ..... 428/7; 428/16

[58] Field of Search ..... 428/7, 16

[56] References Cited

U.S. PATENT DOCUMENTS

| | | | |
|---|---|---|---|
| D. 332,026 | 12/1992 | Corcoran-Curio | D6/617 |
| 2,892,278 | 6/1959 | Hoeflich | 428/16 X |
| 3,939,976 | 2/1976 | VanIseghem, Jr. | 206/390 |
| 4,153,097 | 5/1979 | Pettibone | 428/100 X |
| 4,328,271 | 5/1982 | Rountree | 428/66.5 |
| 4,484,529 | 11/1984 | Caldares | 108/90 |

*Primary Examiner*—Deborah Jones
*Assistant Examiner*—Jason Resnick
*Attorney, Agent, or Firm*—Flanagan & Flanagan; John R. Flanagan; John K. Flanagan

[57] ABSTRACT

A functional tablecloth assembly includes a tablecloth, placement indicators and holder elements. The tablecloth covers a table. The placement indicators are attached to the tablecloth for guiding placement of place-setting items on the tablecloth. The holder elements are attached to the tablecloth for retaining the place-setting items thereon. The placement indicators includes ruffle attached to the tablecloth. The holder elements are loops and/or pockets made by attaching patches of material on the tablecloth.

18 Claims, 3 Drawing Sheets

FUNCTIONAL TABLECLOTH ASSEMBLY HAVING ITEM PLACEMENT INDICATORS AND HOLDER ELEMENTS

This patent application claims the benefit of provisional application No. 60/048,509, filed Jun. 4, 1997.

BACKGROUND OF THE INVENTION

1. Field of the Invention

The present invention generally relates to table coverings and, more particularly, is concerned with a functional tablecloth assembly having item placement indicators and holder elements.

2. Description of the Prior Art

It is often desirable to cover a table with a cloth or the like to protect a top or any other portion of the table from stains or other damage which may be incurred during a meal or other function. These table coverings are commonly known as tablecloths. It is further often desirable to set a table with plates, utensils, napkins, glassware and other items used during a meal. The proper placement of such items on a table, however, can be time consuming. A variety of table coverings have therefore been developed over the years toward reducing the effort and time required in setting a table.

Representative examples of these prior art table coverings are disclosed in U.S. Pat. No. 3,939,976 to VanIseghem, Jr., U.S. Pat. No. 4,328,271 to Rountree, U.S. Pat. No. 4,484,529 to Caldares and U.S. Des. Pat. No. 332,026 to Corcoran-Curcio. While these prior art table coverings appear to be satisfactory in use for the specific purposes for which they were designed, none of them seem to provide an effective and comprehensive solution for the problem at hand.

Consequently, a need remains for a table covering which provides an optimum solution to the aforementioned problem in the prior art without introducing any new problems in place thereof.

SUMMARY OF THE INVENTION

The present invention provides a functional tablecloth assembly which is designed to satisfy the aforementioned need. The functional tablecloth assembly of the present invention reduces the effort and time required in setting a table. The functional tablecloth assembly includes one or more item placement indicators and holder elements which provide an effective and comprehensive solution for quickly and accurately positioning various place-setting items on a table.

Accordingly, the present invention is directed to a functional tablecloth assembly which comprises: (a) a tablecloth for covering a table; and (b) at least one and preferably a plurality of placement indicators each attached to the tablecloth for guiding placement of a place-setting item on the tablecloth. Each placement indicator includes at least one and preferably a plurality of ruffles. The tablecloth and the ruffles are made of a substantially flexible, and preferably washable, material. Further, the ruffles may be disposed on the tablecloth in various configurations, such as in substantially parallel relation to one another, in substantially criss-crossing relation to one another, or arranged in the configuration of an object, such as a sailboat.

The present invention is also directed to a functional tablecloth assembly which comprises: (a) a tablecloth for covering a table; and (b) at least one and preferably a plurality of holder elements each in the form of a loop and/or pocket attached to the tablecloth for retaining at least one place-setting item. Each holder element includes a patch of material made of a substantially flexible, and preferably washable, material. When the holder element is in the form of a loop, the patch of material has opposite sides and opposite ends. The opposite sides are attached to the tablecloth whereas the opposite ends are spaced from the tablecloth and thereby provide openings between the patch of material and the tablecloth at the opposite ends to form a loop with the tablecloth such that the one item may pass through the openings and be disposed between the patch of material and the tablecloth. The patch of material may also be substantially in the shape of an object, such as an anchor, having opposite ends attached to the tablecloth. The patch of material may also be substantially in the shape of another object, such as a boat, having opposite ends attached to the tablecloth.

When the holder element is in the form of a pocket, the patch of material has opposite sides and opposite first and second ends. The opposite sides and first end are attached to the tablecloth. The second end is spaced from the tablecloth and thereby provides an opening between the patch of material and the tablecloth at the second end and forms a pocket with and upon the tablecloth such that the one item may pass into and be disposed within the pocket upon the tablecloth.

The holder element may also be in the form of a loop and a pocket formed on the loop. When the holder element is in the form of a loop and pocket, the holder element is comprised of a first patch of material and a second patch of material. The first patch of material has opposite sides, opposite ends and an outer surface facing away from the tablecloth. The opposite sides of the first patch of material are attached to the tablecloth whereas the opposite ends of the first patch of material are spaced from the tablecloth and thereby provide openings between the first patch of material and the tablecloth at the opposite ends of the first patch of material and forms a loop with the tablecloth such that the one item may pass through the openings and be disposed between the first patch of material and the tablecloth.

The second patch of material has opposite sides and opposite first and second ends. The opposite sides and the first end of the second patch of material are attached to the outer surface of the first patch of material whereas the second end of the second patch is spaced from the first patch of material and thereby provides an opening between the first patch of material and the second patch of material at the second end of the second patch of material and forms a pocket with the first patch of material such that the one item may pass into and be disposed within the pocket. The second patch of material has a size smaller than the first patch of material.

The functional tablecloth assembly may also comprise at least one puppet and at least one string. Each string has opposite ends. One end is attached to the puppet and the other end is attached to a holder element such that the puppet is storable within the holder element.

The present invention is further directed to a functional tablecloth assembly which comprises: (a) a tablecloth for covering a table; (b) at least one and preferably a plurality of placement indicators attached to the tablecloth for guiding placement of place-setting items on the tablecloth; and (c) at least one and preferably a plurality of holder elements attached to the tablecloth for retaining place-setting items on the tablecloth.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
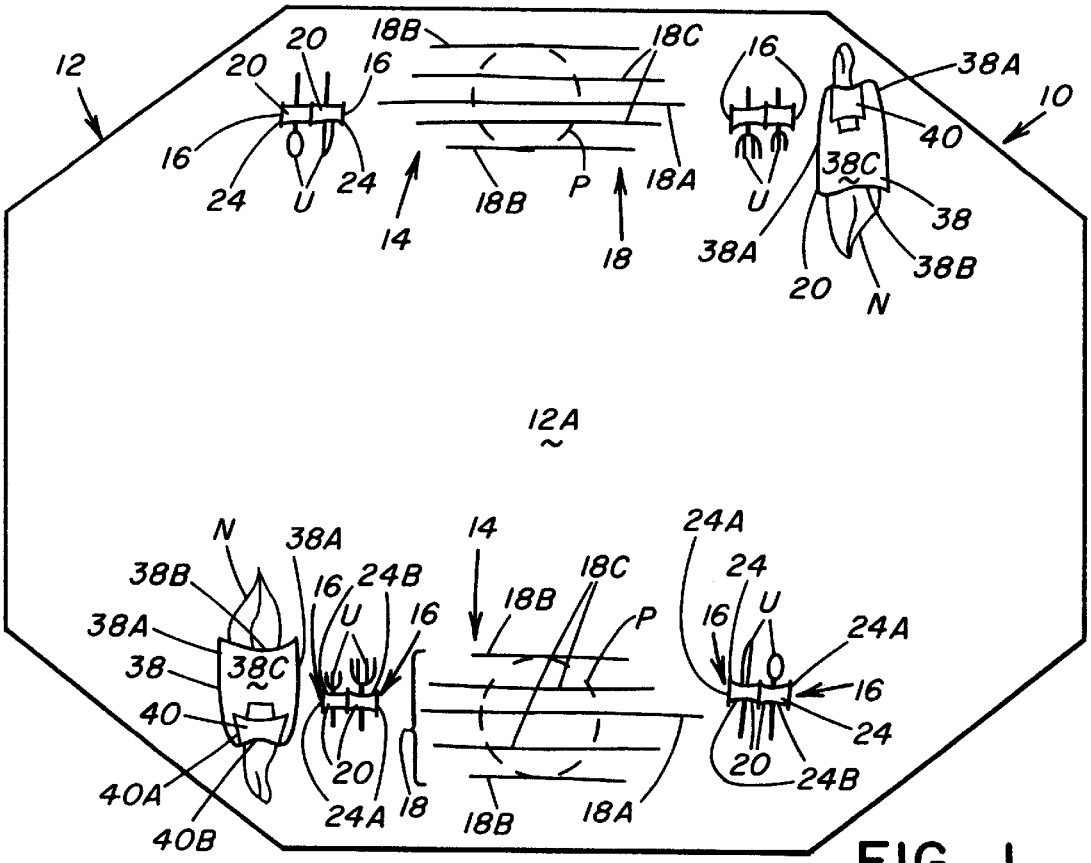
FIG. 1 is a top plan view of one embodiment of a functional tablecloth assembly of the present invention.

Referring to the drawings and particularly to FIG. 1, there is illustrated a functional tablecloth assembly, generally designated 10, of the present invention. The functional tablecloth assembly 10 basically includes a tablecloth 12 for covering a table A and at least one and preferably a plurality of placement indicator 14 attached to the tablecloth 12 for guiding placement of a plurality of place-setting items, such as plates P, on the tablecloth 12. The assembly 10 also includes at least one and preferably a plurality of holder elements 16 attached to the tablecloth 12 for retaining place-setting items. Examples of other place-setting items are napkins N and utensils U (such as a knife, fork and spoon).

Referring now to FIGS. 1–4, the tablecloth 12 can be of any conventional type, and the tablecloth 12, item placement indicators 14 and item holder elements 16 are preferably made of a substantially flexible washable material being the same for each, though they need not be so limited, and may have any suitable size and shape. The tablecloth 12 may include a central table top portion 12A and a peripheral skirt portion 12B. The central table top portion 12A covers a top of the table A whereas the peripheral skirt portion 12B extends downwardly from a periphery of the table top portion 12A and of the table A and covers a portion of a space below the top of the table A. The placement indicators 14 are preferably attached to the central table top portion 12A of the tablecloth 12, though need not be so limited. The holder elements 16 are preferably attached to the central table top portion 12A, though one or more of the holder elements 16 may additionally or solely be attached to the peripheral skirt portion 12B of the tablecloth 12. The placement indicators 14 and the holder elements 16 are particularly attached by being sewn, or by any other suitable means, to the tablecloth 12.

Figure 4:
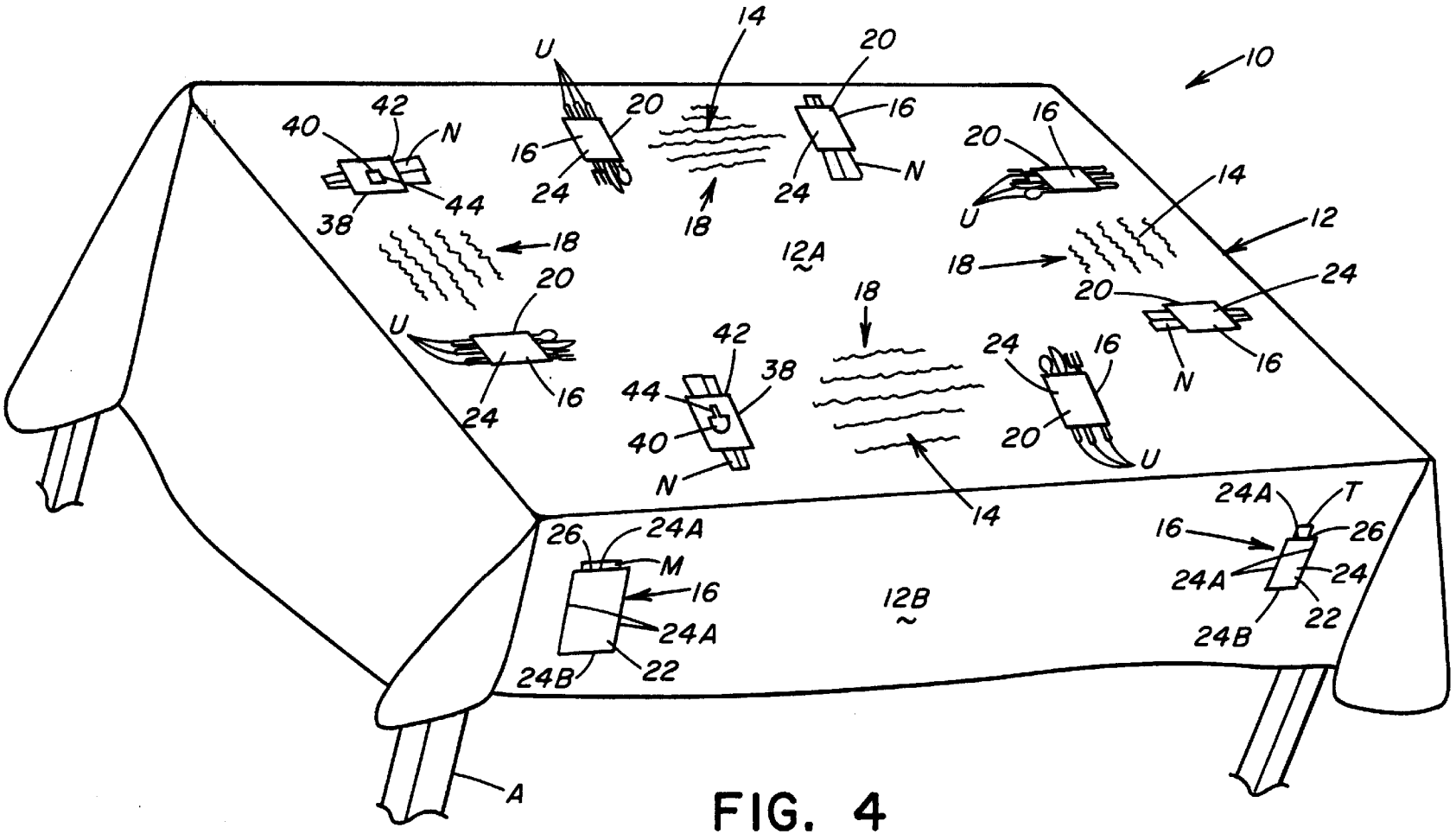
FIG. 4 is a perspective view of yet another embodiment of the assembly.

The placement indicator 14 includes at least one and preferably a plurality of pieces of flexible decorative material in the form of ruffles 18. The one or more placement indicators 14 preferably include a plurality of ruffles 18. The plurality of ruffles 18 may be arranged in substantially parallel relation to one another, as shown in FIGS. 1 and 4. The ruffles 18 may be of any suitable number, such as five as shown, with a middle one of the ruffles 18A having a length which is greater than the length of either of the other ruffles 18 and with a pair of opposite end ruffles 18B having about the same length which is less than the length of the other two intermediate ruffles 18C which are disposed between the opposite end ruffles 18B and the middle ruffle 18A. However, the lengths of the ruffles 18A, 18B and 18C need not be so limited. The placement indicators 14 is intended to indicate the desired locations for placement of plates P (including any other place-setting items) having food thereon for individual persons sitting at the table A. These placement indicators 14 are therefore spaced from one another and disposed on the central table top portion 12A of the tablecloth 12 adjacent to where the central table top portion 12A meets the peripheral skirt portion 12B of the tablecloth 12 and thereby adjacent to the edge of the top of the table A so as to also allow sufficient space between the individual persons who are seated at the table A. These placement indicators 14 may number two as shown in FIG. 1, or may number four as shown in FIG. 4, or may be of any other suitable and desirable number based on the size of the tablecloth 12 and table A.

Figure 3:
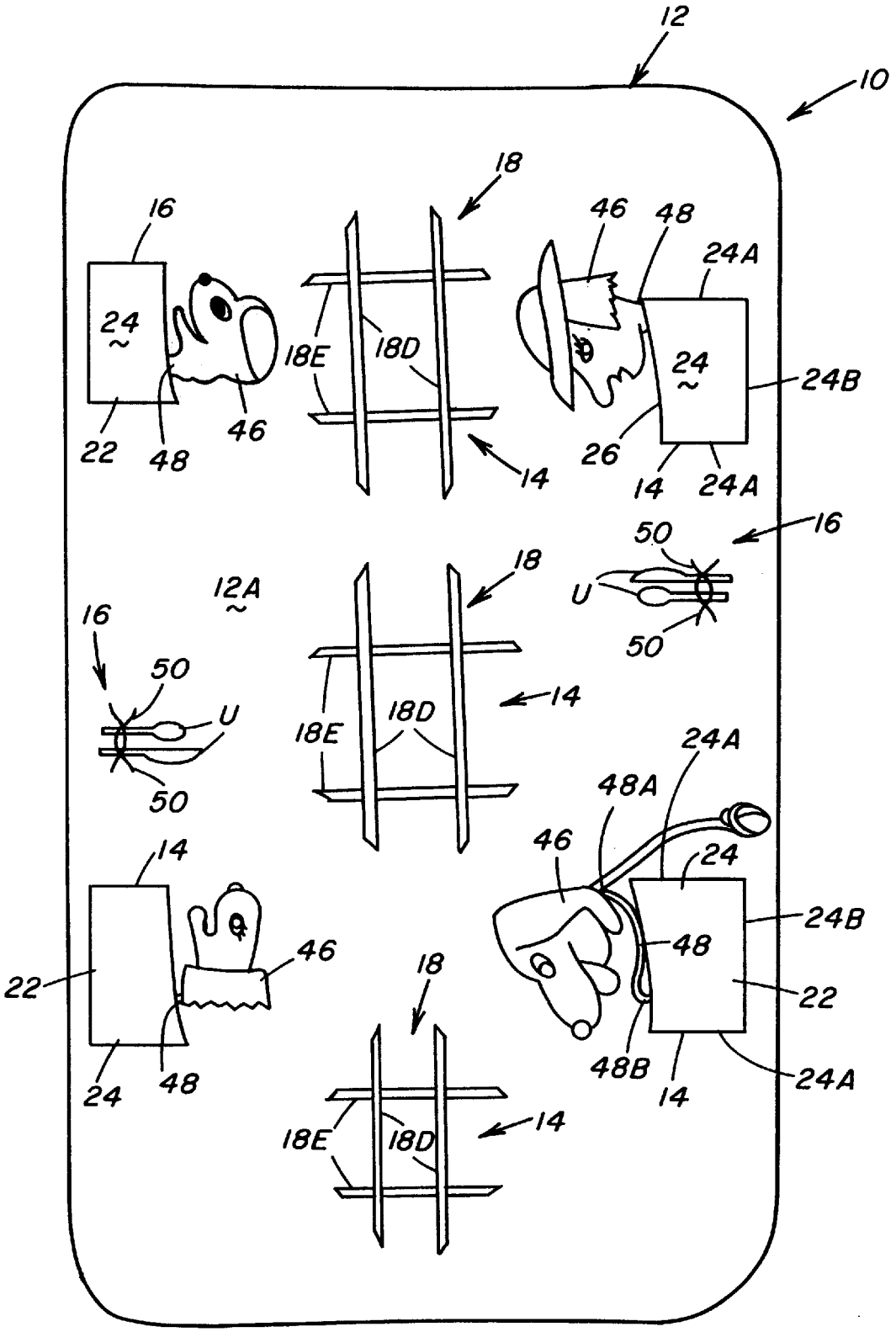
FIG. 3 is a top plan view of still another embodiment of the assembly.

In an alternative embodiment, the plurality of ruffles 18 of each placement indicator 14 may be disposed in substantially crisscrossing relation to one another, as shown in FIG. 3. The ruffles 18 may be of any suitable number, such as three as shown, with a pair of longitudinal ruffles 18D having about the same length which is greater than the length of a pair of transverse ruffles 18E, though the lengths of the ruffles 18D, 18E need not be so limited. These placement indicators 14 are intended to indicate locations for placement of plates P (including dishes, pans, pots or any other like containers which have food thereon or therein) for all of the persons who are seated at the table A. These placement indicators 14 are therefore spaced from one another and disposed centrally on the central table top portion 12A of the tablecloth 12 such that the placement indicators 14 are within reach of each of the individual persons who are seated at the table A.

Figure 2:
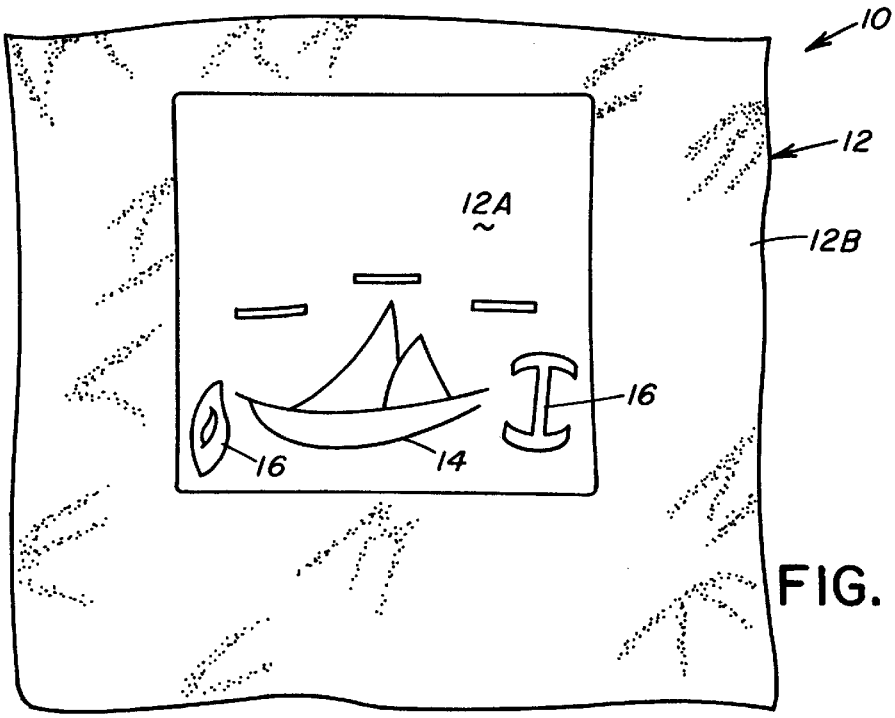
FIG. 2 is a top plan view of another another of the assembly.

In another alternative embodiment, the plurality of ruffles 18 of each placement indicator 14 may be arranged in substantially the configuration of an object, such as sailboat, as shown in FIG. 2. The placement indicators 14 which have the ruffles 18 in this arrangement are, like the placement indicators 14 in FIGS. 1 and 4, also intended to indicate the desired locations for placement of plates P for use by individuals who are seated at the table A, though need not be so limited. The ruffles 18 may further have any other suitable and desirable arrangement such as to express themes of holidays, sports, birthdays or other events.

Referring now again to FIGS. 1–4, each of the holder element 16 may be in the form of either a loop 20 or a pocket 22. Each loop 20 is preferably attached to the central table top portion 12A of the tablecloth 12, though need not be so limited. Each pocket 22 is preferably attached to the peripheral skirt portion 12B of the tablecloth 12, though need not be so limited. The holder elements 16 each includes a patch of material 24 made of a substantially flexible washable material, such as the same type of material from which the tablecloth 12 and placement indicators 14 are made, though need not be so limited.

When the holder element 16 is in the form of the loop 20, the patch of material 24 has opposite sides 24A and opposite ends 24B. The opposite sides 24A are attached to the tablecloth 12 whereas the opposite ends 24B are spaced from the tablecloth 12 and thereby provide openings 26 between the patch of material 24 and the tablecloth 12 at the opposite ends 24B so as to form the loop 20 with the tablecloth 12 such that the place-setting item(s), either napkin N or utensil U, may pass through the openings 26 and be disposed between the patch of material 24 and the tablecloth 12. The loop 20 may be of a large size for receiving the napkin N or a plurality of the utensils U (knife, fork, spoon), such as the loops 20 shown in FIGS. 1, 3 and 4. The loop 20 may be of a small size for receiving only one utensil U, such as the loops 20 shown in FIG. 1. The patch of material 24 may be substantially in the shape of an object, such as an anchor 28, having opposite ends 38A attached to the tablecloth 12, as shown in FIG. 2, for receiving the utensils U. Also, the patch of material 24 may be substantially in the shape of another object, such as a boat 30, having opposite ends 30A attached to the tablecloth 12, as shown in FIG. 2, for receiving the napkin N.

When the holder element 16 is in the form of the pocket 22, the patch of material 24 has the opposite sides 24A and opposite first and second ends 32, 34. The opposite sides 24A and first end 32 are attached to the tablecloth 12 whereas the second end 34 is spaced from the tablecloth 12 and thereby provides an opening 36 between the patch of material 24 and the tablecloth 12 at the second end 34 and forms the pocket 22 with the tablecloth 12 such that the item(s) may pass into and be disposed within the pocket 22. The pocket 22 may be of a large size for receiving a menu M, such as the large pocket 22 shown in FIG. 4. The pocket 22 may be of a small size for receiving a ticket T, such as the small pocket 32 shown in FIG. 4.

The holder element 16 may also be in the form of a loop 20 with a pocket 22 formed on the loop 20. When the holder element 16 is in the form of a loop 20 with pocket 22, the holder element 16 includes a first patch of material 38 and a second patch of material 40. Each of the first and second patches of material 38, 40 is made of a substantially flexible washable material, such as the same type of material of which the tablecloth 12 is made, though need not be so limited. The first patch of material 38 has opposite sides 38A, opposite ends 38B and an outer surface 38C facing away from the tablecloth 12. The opposite sides 38A of the first patch of material 38 are attached to the tablecloth 12 whereas the opposite ends 38B of the first patch of material 38 are spaced from the tablecloth 12 and thereby provide openings 42 between the first patch of material 38 and the tablecloth 12 at the opposite ends 38B of the first patch of material 38 and form a loop 20 with the tablecloth 12 such that the place-setting item(s) may pass through the openings 42 and be disposed between the first patch of material 38 and the tablecloth 12. The second patch of material 40 has opposite sides 40A and opposite first and second ends 40B, 40C. The opposite sides 40A and the first end 40B of the second patch of material 40 are attached to the outer surface 38C of the first patch of material 38. The second end 40C of the second patch of material 40 is spaced from the first patch 38 and thereby provides an opening 44 between the first patch of material 38 and the second patch of material 40 at the second end 40C of the second patch of material 40 and forms a pocket 22 with the first patch of material 38 such that the item(s) may pass into and be disposed within the pocket 22. The second patch of material 40 has a size smaller than the first patch of material 38, though need not be so limited. The loop 20 formed by the first patch of material 38 is of the large type and the pocket 22 formed by the second patch of material 40 is of a size smaller than the small pocket 22, though the loop 20 and pocket 22 need not be so limited in this arrangement, as shown in FIGS. 1 and 4.

Referring now to the embodiment of FIG. 3, the assembly 10 may further include at least one puppet 46 and at least one string 48. Each string 48 has opposite ends 48A, 48B. End 48A is attached to the puppet 46 while the end 48B is attached to the holder element 16 such that the puppet 46 is storable within the holder element 16. The puppets 46 preferably number the same as the number of placement indicators 14. The puppets 46 may have any suitable and desirable shape and size for augmenting a theme, such as that of Halloween, as shown in FIG. 3, or of any other occasion.

As an alternative to the loops 20 and pockets 22, the holders 16 for holding items such as the utensils U can take the form of pairs of ribbons or strings 50 attached to the tablecloth 12 and used as tie-downs. The material can take various suitable forms, such as cloth or fabric that is inelastic or elastic. Also, the placement indicators 14 eliminate the need to provide and use separate plate mats.

As mentioned above, the functional tablecloth assembly 10 of the present invention permits the expression of many shapes and themes such as holidays, sports and birthdays among others. One such theme illustrated in FIG. 2 is the ocean and sailboats. The tabletop portion 12A can be white in color with a blue fishnet skirt portion 12B and a red edge or border therebetween. The placement indicators 14 are sailboat shaped, the utensil holder elements 16 are shaped like anchors and the napkin holder elements 16 are boat-shaped. The assembly 10 can be provided to augment the festive atmosphere of a party setting, particularly for young children but not necessarily so limited. FIG. 3 shows a tablecloth 12 decorated for a halloween theme by having ghosts, moons and bats printed thereon. The colors can be orange, black, yellow and white. The skirt can be black. The center portion 12A of the tablecloth 12 has three tic-tac-toe placement indicators 14 applied thereon which also can be used to guide the placement of cake, cookie and refreshment trays on the tablecloth 12.

The embodiment of FIG. 4 is more for commercial or restaurant settings where the tablecloth A has the menu and ticket/tip pockets 22 attached to the skirt portion 12B of the tablecloth 12 near the corners thereof.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A functional tablecloth assembly, comprising:

(a) a tablecloth having at least a top portion for covering a table; and (b) a plurality of plate placement indicators on said top portion of said tablecloth being formed by pieces of flexible decorative material attached upon and extending upwardly from said top portion of said tablecloth, said pieces of decorative material being incapable of holding food or of use in eating food and instead being adapted to guide the removable placement thereover on said tablecloth of a plurality of separate plates being capable of holding food.

2. The assembly of claim 1 wherein said pieces of flexible decorative material forming some of said plate placement indicators are ruffles.

3. The assembly of claim 2 wherein said pieces of flexible decorative material forming some of said plate placement indicators include pluralities of said ruffles arranged in substantially parallel relation to one another.

4. The assembly of claim 2 wherein said pieces of flexible material forming some of said plate placement indicators include pluralities of said ruffles arranged in substantially crisscrossing relation to one another.

5. The assembly of claim 2 wherein said pieces of flexible material forming some of said plate placement indicators include pluralities of said ruffles arranged in the configuration of an object.

6. The assembly of claim 1 further comprising:

a plurality of holder elements made of flexible material attached upon and extending above said top portion of said tablecloth and being arranged adjacent to said plate placement indicators, each of said holder elements being incapable of holding food or of use in eating food and instead being adapted to removably retain at least one place-setting item on said top portion of said tablecloth where the place-setting item is available for use while eating food.

7. The assembly of claim 6 wherein some of said holder elements include a patch of material having opposite sides and opposite ends, said opposite sides being attached to said tablecloth, said opposite ends being spaced from said tablecloth and thereby providing openings between said patch of material and said tablecloth at said opposite ends so as to form a loop with said tablecloth allowing the at least one item to pass through said openings and be disposed between said patch of material and said tablecloth.

8. The assembly of claim 6 wherein some of said holder elements include a patch of material having opposite sides and opposite first and second ends, said opposite sides and said first end being attached to said tablecloth and said second end being spaced from said tablecloth to thereby provide an opening between said patch of material and said tablecloth at said second end and form a pocket with said tablecloth allowing the at least one item to pass into and be disposed within said pocket.

9. The assembly of claim 6 wherein some of said holder elements include:

a first patch having opposite sides, opposite ends and an outer surface facing away from said tablecloth, said opposite sides of said first patch of material being attached to said tablecloth and said opposite ends of said first patch of material being spaced from said tablecloth to thereby provide openings between said first patch of material and said tablecloth at said opposite ends of said first patch of material and form a loop with said tablecloth permitting the at least one item to pass through said openings and be disposed between said first patch of material and said tablecloth; and a second patch of material having opposite sides and opposite first and second ends, said opposite sides and said first end of said second patch of material being attached to said outer surface of said first patch of material and said second end of said second patch of material being spaced from said first patch of material to thereby provide an opening between said first patch of material and said second patch of material at said second end of said second patch of material and form a pocket with said first patch of material permitting the at least one item to pass into and be disposed within said pocket.

10. The assembly of claim 6 wherein some of said holder elements include a patch of material substantially in the shape of an object having opposite ends attached to said tablecloth and forming a loop with said tablecloth permitting the at least one item to pass between said patch and said tablecloth.

11. The assembly of claim 6 further comprising:

at least one puppet; and at least one string having opposite ends, one of said opposite ends being attached to said puppet and the other of said opposite ends being attached to one of said holder elements such that said puppet is storable within said holder element.

12. A functional tablecloth assembly, comprising:

(a) a tablecloth having at least a top portion for covering a table; and (b) a plurality of holder elements made of flexible material attached upon and extending above said top portion of said tablecloth, each of said holder elements being incapable of holding food or of use in eating food and instead being adapted to removably retain at least one place-setting item on said top portion of said tablecloth where the place-setting item is available for use while eating food;

(c) at least some of said holder elements including pairs of strips of flexible material, each of said strips having a pair of opposite ends, only one of said opposite ends of each of said strips being attached to said tablecloth such that said strips of each respective pair thereof can be releasably tied together over at least one place-setting item so as to provide releasable tie-downs on said tablecloth that hold the at least one place-setting item at the desired position on said tablecloth.

13. A functional tablecloth assembly, comprising:

(a) a tablecloth having at least a top portion for covering a table; and (b) a plurality of holder elements made of flexible material attached upon and extending above said top portion of said tablecloth, each of said holder elements being incapable of holding food or of use in eating food and instead being adapted to removably retain at least one place-setting item on said top portion of said tablecloth where the place-setting item is available for use while eating food;

(c) at least some of said holder elements including a patch of material having opposite sides and opposite first and second ends, said opposite sides and said first end being attached to said tablecloth and said second end being spaced from said tablecloth to provide an opening between said patch of material and said tablecloth at said second end and thereby form a pocket with said tablecloth allowing the at least one place-setting item to pass into and be disposed with said pocket.

14. The assembly of claim 13 wherein said patch of material is substantially in the shape of an object.

15. The assembly of claim 13 further comprising:

at least one puppet; and at least one string having opposite ends, one of said opposite ends being attached to said puppet and the other of said opposite ends being attached to one of said holder elements such that said puppet is storable within said pocket of said holder element.

16. A functional tablecloth assembly, comprising:

(a) a tablecloth for covering a table and having a top portion and a skirt portion depending downward from a periphery of said top portion;

(b) a plurality of plate placement indicators attached upon and extending above said top portion of said tablecloth for guiding removable placement of a plurality of plates on said top portion of said tablecloth;

(c) a first plurality of holder elements attached upon and extending above said top portion of said tablecloth for removably retaining place-setting items thereon; and (d) a second plurality of holder elements attached upon and extending outwardly from said skirt portion of said tablecloth for removably retaining at least one item therein, said holder elements of said second plurality including a patch of material having opposite sides and opposite upper and lower ends, said opposite sides and said lower end being attached to said tablecloth and said upper end being spaced from said tablecloth to provide an opening between said patch of material and said tablecloth at said upper end and thereby form a pocket with said tablecloth allowing the item to pass into and be disposed with said pocket.

17. The assembly of claim 12 wherein said strips of flexible material are ribbons.

18. The assembly of claim 12 wherein said strips of flexible material are strings.

* * * * *